US008890750B2

(12) United States Patent
Mak et al.

(10) Patent No.: US 8,890,750 B2
(45) Date of Patent: Nov. 18, 2014

(54) SYMMETRICAL PARTIALLY COUPLED MICROSTRIP SLOT FEED PATCH ANTENNA ELEMENT

(75) Inventors: Angus C. K. Mak, Shatin (CN); Corbett R. Rowell, Mongkok (CN); Hau Wah Lai, Shatin (HK)

(73) Assignee: Hong Kong Applied Science and Technology Research Institute Co., Ltd., Shatin (HK)

( * ) Notice: Subject to any disclaimer, the term of this patent is extended or adjusted under 35 U.S.C. 154(b) by 508 days.

(21) Appl. No.: 13/229,274

(22) Filed: Sep. 9, 2011

(65) Prior Publication Data

US 2013/0063310 A1 Mar. 14, 2013

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 21/08*** | (2006.01) |

(52) U.S. Cl.

CPC ..... *H01Q 1/246* (2013.01); *H01Q 9/0457* (2013.01); *H01Q 21/08* (2013.01)

USPC ..... 343/700 MS; 343/767; 343/770

(58) Field of Classification Search

CPC ... H01Q 9/0457; H01Q 9/0435; H01Q 19/30; H01Q 13/18; H01Q 9/0407; H01Q 5/0051; H01Q 21/0075; H01L 2223/6627

See application file for complete search history.

(56) References Cited

U.S. PATENT DOCUMENTS

| | | | | |
|---|---|---|---|---|
| 4,672,386 | A * | 6/1987 | Wood | 343/770 |
| 5,661,493 | A * | 8/1997 | Uher et al. | 343/700 MS |
| 5,977,924 | A * | 11/1999 | Takei et al. | 343/770 |
| 6,195,063 | B1 | 2/2001 | Gabriel et al. | |
| 6,229,484 | B1 | 5/2001 | Sagisaka | |
| 6,424,299 | B1 * | 7/2002 | Cha et al. | 343/700 MS |
| 6,531,984 | B1 * | 3/2003 | Johannisson et al. | 343/700 MS |
| 6,549,166 | B2 * | 4/2003 | Bhattacharyya et al. | 343/700 MS |
| 6,593,887 | B2 | 7/2003 | Luk et al. | |
| 6,989,793 | B2 * | 1/2006 | Van Der Poel | 343/700 MS |

(Continued)

FOREIGN PATENT DOCUMENTS

CN 1252174 A 5/2000

OTHER PUBLICATIONS

P. Brachat and J. M. Baracco, "Printed radiating element with two highly decoupled input ports," Electronic Letters, Feb. 16, 1995, vol. 31 No. 4, pp. 245-256.

(Continued)

*Primary Examiner* — Trinh Dinh

(74) *Attorney, Agent, or Firm* — Fulbright & Jaworski LLP

(57) ABSTRACT

Systems and methods which utilize a symmetrical partially coupled microstrip slot feed patch antenna element configuration to provide highly decoupled dual-polarized wideband patch antenna elements are shown. Embodiments provide a microstrip slot feed configuration in which a slot of a first signal feed is centered with respect to the patch and further provide a microstrip slot feed configuration in which slots of a second signal feed are symmetrically disposed with respect to the center of the patch and at positions near the edges of the patch. The microstrip feed utilized in communicating signals with respect to the slots of the second signal feed is adapted to provide signals of substantially equal amplitude and 180° out of phase with respect to each other according to embodiments. The second signal feed configuration utilized according to embodiments provides partial coupling between the patch and the second signal feed.

28 Claims, 12 Drawing Sheets

(56) References Cited

U.S. PATENT DOCUMENTS

| | | | | |
|---|---|---|---|---|
| 7,864,117 | B2 * | 1/2011 | Aurinsalo et al. | 343/700 MS |
| 2003/0214438 | A1 * | 11/2003 | Hatch et al. | 343/700 MS |
| 2004/0125021 | A1 * | 7/2004 | Munk | 343/700 MS |
| 2006/0001574 | A1 | 1/2006 | Petros | |
| 2007/0126651 | A1 | 6/2007 | Snyder et al. | |

OTHER PUBLICATIONS

Office Action issued for Chinese Patent Application No. 201210323488.2, dated Mar. 18, 2014, 5 pages with English language translation.

* cited by examiner

SYMMETRICAL PARTIALLY COUPLED MICROSTRIP SLOT FEED PATCH ANTENNA ELEMENT

TECHNICAL FIELD

The invention relates generally to wireless communications and, more particularly, to dual-polarized wideband patch antenna configurations

BACKGROUND OF THE INVENTION

Various configurations of antenna elements and antenna array configurations have been used for providing wireless communications in systems such as Global System for Mobile Communications (GSM), third generation mobile telecommunications (3G), fourth generation mobile telecommunications (4G), 3GPP Long Term Evolution (LTE), Universal Mobile Telecommunications System (UMTS), wireless fidelity (Wi-Fi), Worldwide Interoperability for Microwave Access (WiMAX), and Wireless Broadband (WiBro). In providing broadband wireless communications, a base station, access point, or other communication node (collectively referred to herein as base stations) often include an array of antenna elements operable to illuminate a service area for providing broadband wireless communications.

An antenna element array as may be utilized by the aforementioned base stations may include a plurality of antenna element columns, each including a plurality of antenna elements, which are coupled to a feed network operable to provide desired antenna patterns (also referred to as "beams") throughout the service area. In a typical base station antenna system, a plurality of antenna elements (e.g., 4-8) would be disposed with a particular relative spacing (e.g., ¼, ½, or 1 wavelength) to provide an antenna element column. A plurality of antenna element columns (e.g., 3-12) are generally provided, often with a particular relative spacing (e.g., ¼, ½, or 1 wavelength). The signals of the individual elements and/or antenna element columns are combined to constructively and destructively sum and thereby define desired antenna patterns. As can readily be appreciated, such antenna system configurations may comprise a relatively large number of individual antenna elements and/or a complex feed network. Accordingly, base station antenna systems are often costly in both material and the labor required to construct them.

Adding further to the complexity and cost of such antenna systems is the use of dual-polarization (e.g., slant left/slant right or horizontal/vertical) at the base station, such as for signal diversity, multiple-input multiple-output (MIMO), etc. For example, individual antenna elements often must themselves be dual-polarized, requiring dual signal feeds and signal isolation. Alternatively, the number of antenna elements must be doubled to provide individual elements for each desired polarization. Both of the foregoing configurations adds to the base station antenna system costs in both material and the labor required to construct them.

The cost and complexity of the individual antenna elements themselves is not trivial. For example, many current base station antenna system configurations utilize dipole antenna elements such as shown in FIG. 1A. Such dipole antenna elements are a three-dimensional metal structure comprising a pair of metal aerials (e.g., aerials 101*a* and 101*b*) physically coupled to a signal feed (e.g., feed 110) which may comprise a balun or other relatively complicated circuitry. Thus, such dipole antenna elements are relatively complicated and labor intensive to manufacture. Where dual-polarization is desired, two such individual dipole elements must be provided, each having a respective polarization, as shown in FIG. 1B (e.g., slant left dipole element 101 and slant right dipole element 102). Such a dual-polarization configuration substantially increases the complexity and cost of the antenna system.

A more recently developed antenna element configuration which is often less costly to manufacture is the patch antenna as shown in FIG. 2A. Such patch antenna elements comprise a conductive patch (e.g., patch 201), disposed in association with a corresponding a ground plane (e.g., ground plane 220), in communication with a signal feed. For example, the signal feed may comprise a coaxial feed wherein a feed pin physically couples the feed network to the patch antenna element as shown in FIG. 2B (e.g., feed pin 211*b* passing through ground plane 220 without making electrical contact and physically connected, such as by soldering, to patch 201). Such a configuration is relatively expensive and/or complicated to manufacture (e.g., labor intensive to make due to soldering or similar techniques required for the electrical connection). Moreover, the coaxial feed patch antenna element configuration has generally not been found to have good bandwidth performance characteristics.

Accordingly, alternative signal feed configurations for patch antenna elements have been developed. One such signal feed configuration is a L-probe feed wherein a "L" shaped feed pin couples the feed network to the patch antenna element via a dielectric gap as shown in FIG. 2C (e.g., L-probe 211*c* passing through ground plane 220 without making electrical contact and disposed beneath patch 201 to communicate radio frequency (RF) signals there between). This configuration has been found to have improved bandwidth performance characteristics as compared to the aforementioned coaxial feed configuration. However, the L-probe configuration continues to be relatively expensive and/or complicated to manufacture (e.g., labor intensive to position the L-probe and to provide support structure to retain the proper positioning).

Another alternative signal feed configuration used for patch antenna elements is the microstrip slot feed wherein a microstrip line couples the feed network to the patch antenna element via dielectric coupling through a slot as shown in FIG. 2D (e.g., microstrip line 211*d* disposed beneath ground plane 220 and communicating RF signals between patch 201 via slot 221*d* disposed in ground plane 220). Such a configuration is relatively simple to construct using a multilayer printed circuit board providing the proper matching (e.g., dielectric properties) between layers, and thus provides an inexpensive alternative as compared to the aforementioned coaxial feed and L-probe feed patch antenna element configurations. Moreover, as can be seen in FIG. 2C, the microstrip slot feed patch antenna element may be configured to provide dual polarization (e.g., microstrip line 211*d* disposed beneath ground plane 220 and communicating RF signals between patch 201 via slot 221*d* disposed in ground plane 220 providing a first polarization and microstrip line 212*d* disposed beneath ground plane 220 and communicating RF signals between patch 201 via slot 222*d* disposed in ground plane 220 providing a second polarization).

The foregoing microstrip slot feed patch antenna element configuration is not without disadvantage. For example, microstrip slot feed configurations have been found to present difficulties with respect to impedance matching, often requiring the use of a multiple patch configuration as shown in FIG. 2E (e.g., patch 201 and patch 201*e*). Although providing improved impedance matching, the use of such dual patch configurations typically results in antenna pattern distortion at various frequencies (i.e., wideband operation is affected). Additionally, although providing for dual polarization, the asymmetry of the signal feeds results in undesired antenna pattern distortion (e.g., beams formed using an array of the microstrip slot feed antenna elements experience a shift in direction, or tilt, resulting from the asymmetric microstrip slot feed configuration). Moreover, the signal isolation provided between the two microstrip slot feeds by microstrip slot feed patch antenna element configurations is on the order of 20 dB, which in many instances is less than necessary or otherwise desired in providing satisfactory system performance.

Yet another alternative signal feed configuration used for patch antenna elements is the printed highly decoupled input port feed patch antenna element configuration shown in FIGS. 2F and 2G. In the configuration of FIGS. 2F and 2G, the feed network built by the microstrip lines couple the RF signals to the patch antenna elements via dielectric coupling through slots (e.g., microstrip lines 211*f* and 212*f* disposed beneath ground plane 220 and communicating RF signals between patches 201 and 201*f* via slots 221*f* and 222*f* disposed in ground plane 220). Microstrip line 212*f* associated with slots 222*f* couple one of the channel's signal and microstrip line 211*f* associated with slot 221*f* couples the other channel's signal, wherein the ends of microstrip line 212*f* provide coupling of signals to corresponding ones of slots 221*f* of substantially equal amplitude and phase with respect to each other. Although providing for dual polarization, the impedance matching difficulties associated with this printed highly decoupled input port feed configuration necessitates the use of a second patch (e.g., patch 201*f*). Moreover, this printed highly decoupled input port feed configuration results in distorted antenna patterns as various frequencies. Accordingly, the printed highly decoupled input port feed patch antenna element configuration is complicated and relatively costly to manufacture (e.g., two patches) while continuing to suffer from some of the antenna pattern distortion problems of the microstrip slot feed patch antenna element configuration. Also, as the signal level on the slots are fully coupled to the patches, the signal level of coupling through the slots cannot be controlled and creates difficulties with respect to impedance matching.

BRIEF SUMMARY OF THE INVENTION

The present invention is directed to systems and methods which utilize a symmetrical partially coupled microstrip slot feed patch antenna element configuration to provide highly decoupled dual-polarized wideband patch antenna elements. Symmetrical partially coupled microstrip slot feed patch antenna elements of embodiments of the invention are particularly well suited for use in antenna element arrays due to their signal feed symmetry mitigating antenna pattern distortion, such as beam tilt.

Embodiments of the invention provide a microstrip slot feed configuration in which a slot of a first signal feed is centered with respect to the patch. Using this feed slot orientation according to embodiments both the bandwidth and the cross-polarization are improved. Moreover, the associated radiation pattern is symmetrical as the phase center is the same for the slot and the patch.

Embodiments of the invention provide a microstrip slot feed configuration in which slots of a second signal feed are symmetrically disposed with respect to the center of the patch and at positions near the edges of the patch. The microstrip feed utilized in communicating signals with respect to the slots of the second signal feed is adapted to provide signals of substantially equal amplitude and 180° out of phase with respect to each other according to embodiments of the invention. Using this feed slot orientation according to embodiments enables elimination of coupling of field from the slots of the first and second signal feeds (e.g., providing isolation on the order of 30 dB). Moreover, the associated radiation pattern is symmetrical as the phase center is the same for the slots and the patch.

The second signal feed configuration utilized according to embodiments of the invention provides partial coupling between the patch and the second signal feed. Embodiments dispose the slots of the second signal feed such that they are only partially overlaid by the patch. Such configurations according to embodiments of the invention provides improved impedance matching, thereby eliminating the use of a second patch (which distorts the radiation pattern over a frequency range).

Dual-polarized wideband patch antennas of embodiments of the invention provide an antenna element configuration which is relatively simple to manufacture having excellent operating characteristics. The bandwidth supported by dual-polarized wideband patch antenna elements of embodiments facilitates communication over bands such as 2.3 GHz-2.7 GHz, thereby supporting WiFi, WiMAX, 3G, 4G, LTE, and other popular communication standards. The microstrip feed network utilized according to embodiments of the invention is simplified and does not require the use of jumpers, vias, or crossovers. The signal isolation provided by the slot feed configurations of embodiments results in improved antenna efficiency and supports high performance communication techniques, such as high capacity MIMO. Moreover, the phase center of each signal feed matches that of the patch and therefore eliminates certain antenna pattern distortion issues, such as undesired beam tilt.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

FIGS. 3A-3E show details with respect to an embodiment of a dual-polarized wideband patch antenna configuration according to the concepts herein. The embodiment of dual-polarized wideband patch antenna element 300 illustrated in FIGS. 3A-3E is adapted to provide communication of signals associated with port 1 (P1) and port 2 (P2) using a patch antenna configuration which is relatively simple to manufacture and having excellent operating characteristics. The patch antenna element configuration and the associated signal feed configuration provides relatively wideband operation while the orthogonal configuration of the microstrip slot feeds of the two ports facilitates dual polarization operation. Moreover, the microstrip slot feed configuration of embodiments herein provides relatively high signal isolation as between the signals associated with port 1 and port 2 and the signal feed configuration is adapted to eliminate certain antenna pattern distortion issues, such as undesired beam tilt.

Figure 1A:
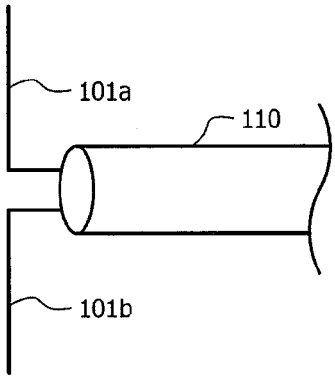
FIG. 1A (Prior Art)
FIGS. 1A and 1B show prior art dipole antenna element configurations.
Figure 1B:
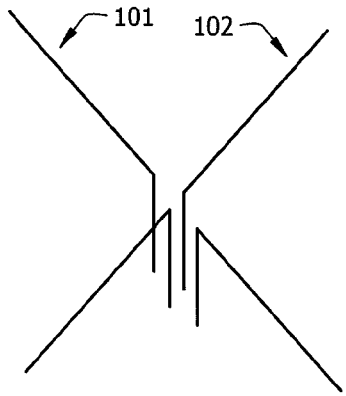
FIG. 1B (Prior Art)
Figure 2A:
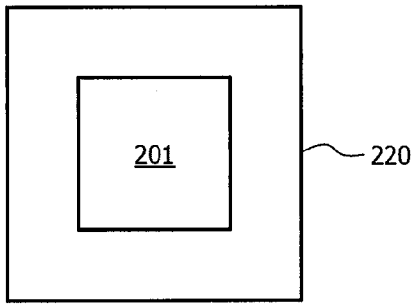
FIG. 2A (Prior Art)
FIGS. 2A-2G show prior art patch antenna element configurations.
Figure 2B:
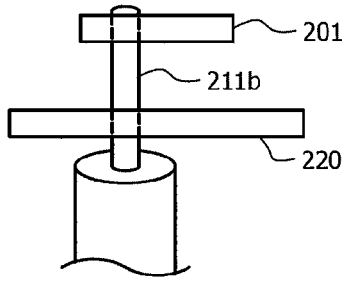
FIG. 2B (Prior Art)
Figure 2C:
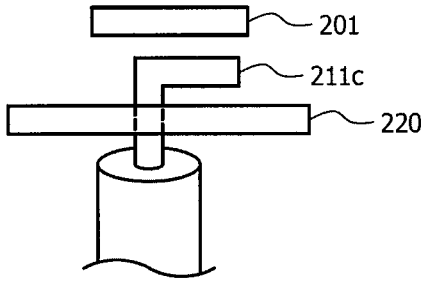
FIG. 2C (Prior Art)
Figure 2D:
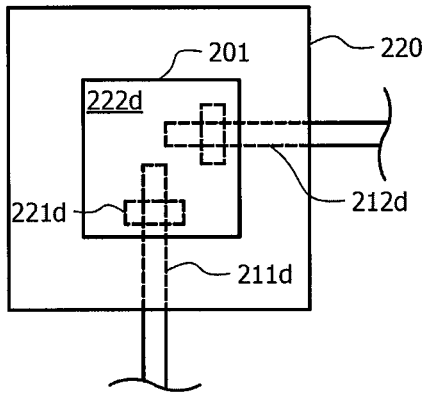
FIG. 2D (Prior Art)
Figure 2E:
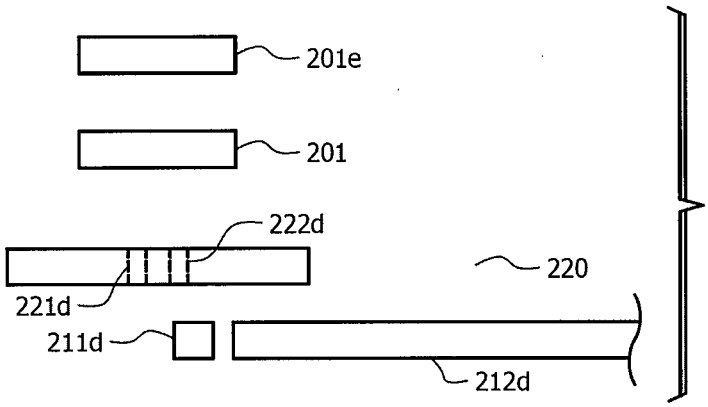
FIG. 2E (Prior Art)
Figure 2F:
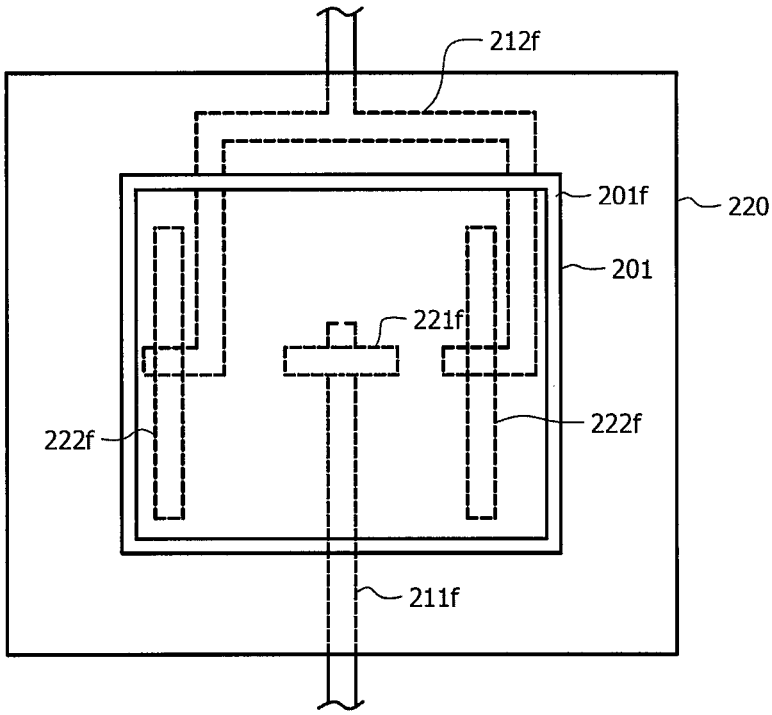
FIG. 2F (Prior Art)
Figure 2G:
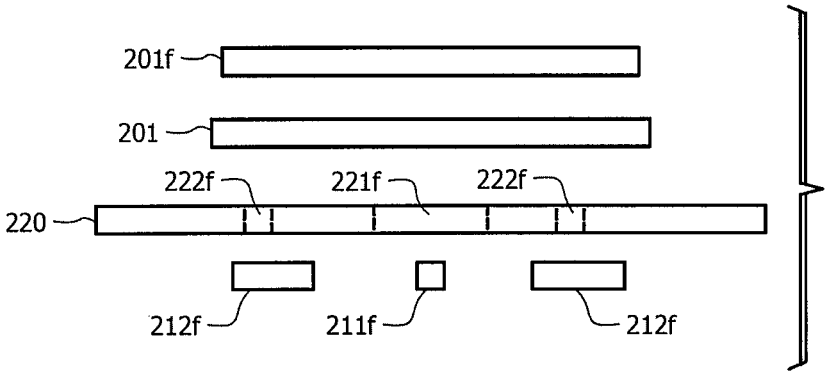
FIG. 2G (Prior Art)
Figure 3A:
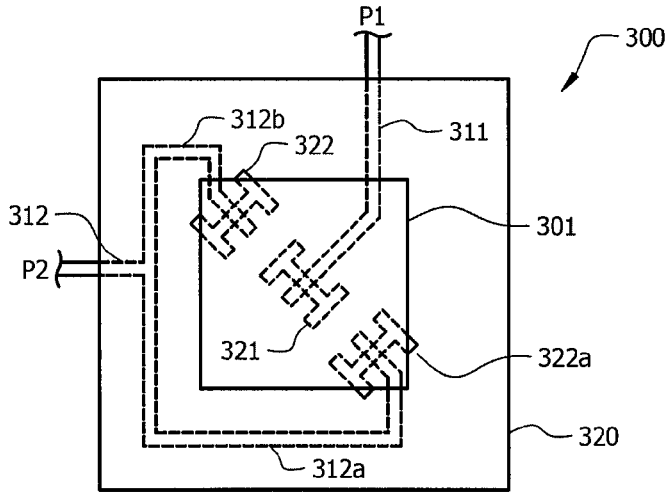
FIGS. 3A-3E show a dual-polarized wideband patch antenna element configuration according to embodiments of the present invention.

As can be seen in the plan view of FIG. 3A, dual-polarized wideband patch antenna element 300 of the illustrated embodiment includes patch 301 disposed in association with ground plane 320. Ground plane 320 has slot 321 therein for coupling signals between patch 301 and a microstrip feed portion of microstrip line 311 of port 1. Ground plane 320 also has slots 322 (slot 322*a* and slot 322*b*) therein for coupling signals between patch 301 and microstrip feed portions of microstrip line 312 of port 2. Although not visible in FIG. 3A, embodiments of dual-polarized wideband patch antenna 300 may comprise an additional ground plane surface disposed on the side of microstrip lines 311 and 312 opposite of ground plane 320, such as to provide a reflector, to improve RF signal propagation attributes of microstrip lines 311 and 312, etc.

A combination of dielectric and air gap is preferably provided between patch 301 and ground plane 320 and between ground plane 320 and microstrip lines 311 and 312. For example, patch 301, ground plane 320, and microstrip lines 311 and 312 may be conductors (e.g., copper traces) deposited upon surfaces of one or more printed circuit board (PCB), although not shown in FIG. 3A for simplifying the drawing thereof, whereby the PCB material (e.g., FP4) is adapted to provide a suitable dielectric. Directing attention to FIG. 3B, an elevation view of dual-polarized wideband patch antenna element 300 is shown. In the embodiment illustrated in FIG. 3B, patch 301 and ground plane 320 are separated by PCB material 331, ground plane 320 and microstrip lines 311 and 312 are separated by PCB material 332, and microstrip lines 311 and 312 and ground plane 320*b* are separated by PCB material 333. Although not shown in the illustration of FIG. 3B, one or more air gap may be utilized in association with or in the alternative to the aforementioned dielectric material (e.g., PCB material). For example, the aforementioned PCBs may be stacked together with air gaps between (e.g., air gap, of a size determined to provide suitable coupling, between PCBs formed by PCB material 331 and 332 and an air gap between PCBs formed by PCB material 332 and 333), such as using spacers or PCB stand-offs in the construction of dual-polarized wideband patch antenna element 300.

Figure 3B:
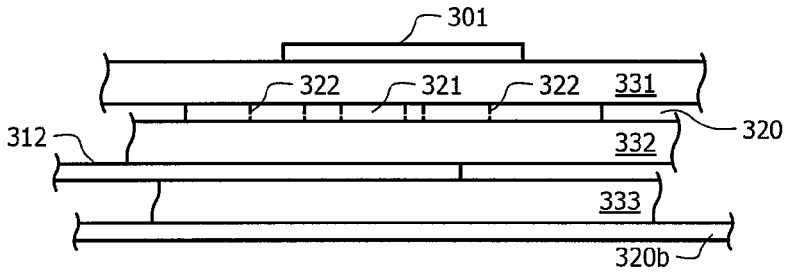
Figure 3C:
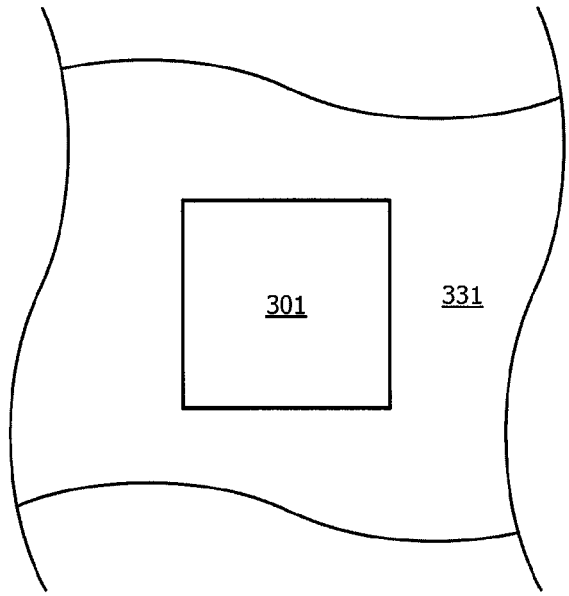
Figure 3D:
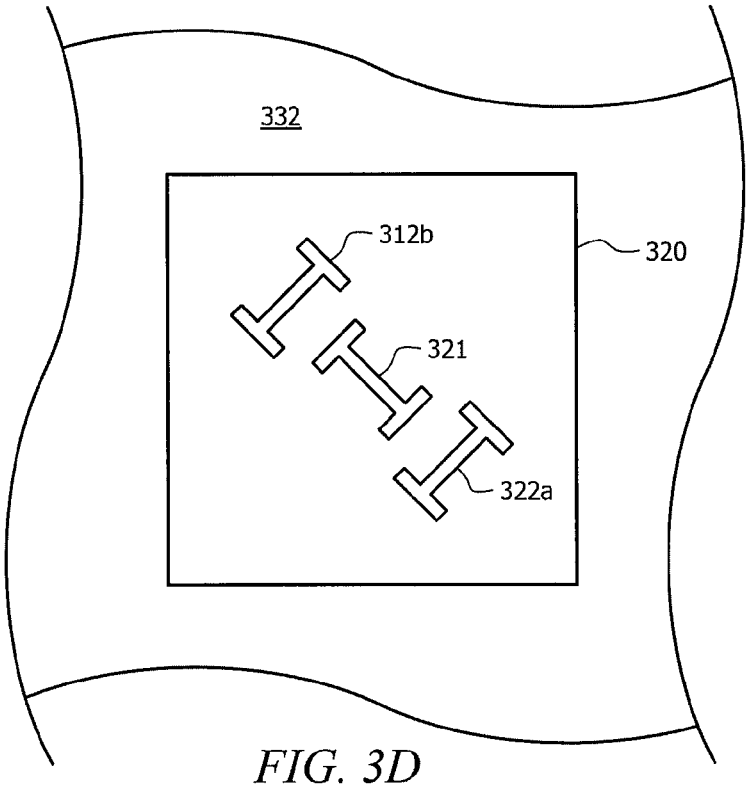
Figure 3E:
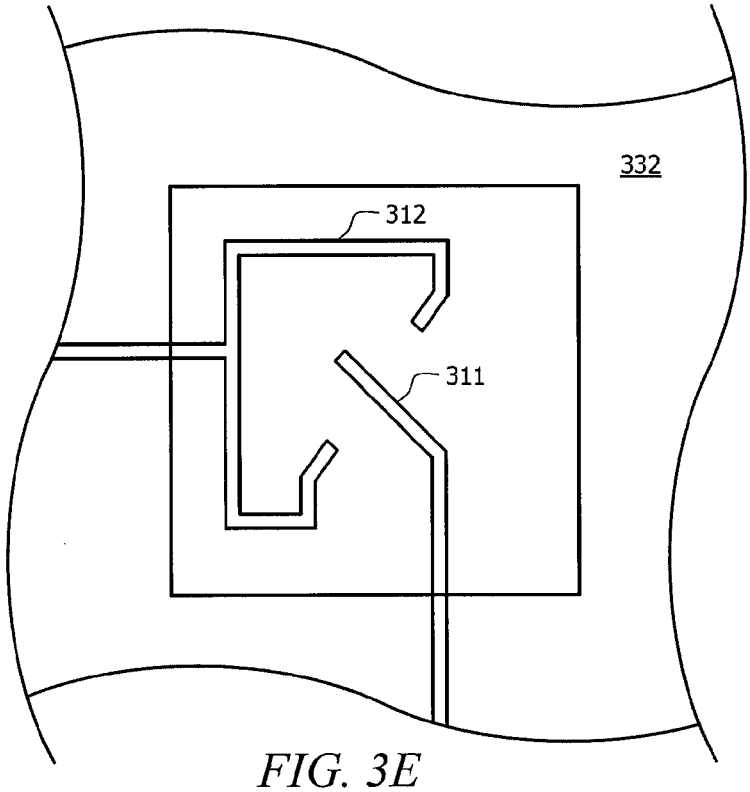

The multilayer configuration of FIG. 3B may be provided, for example, using three separate PCBs "stacked" to provide dual-polarized wideband patch antenna element 300. Directing attention to FIG. 3C, a first PCB may comprise PCB material 331 having patch 310 disposed on a surface thereof. As shown in FIGS. 3D and 3E, a second PCB may comprise PCB material 332 having ground plane 320 (and thus slots 321 and 322) disposed on a first surface thereof and microstrip lines 311 and 312 disposed on a second surface thereof. Although not shown in a separate figure due to there being little to illustrate, a third PCB may comprise PCB material 333 and ground plane 320*b*. These three PCBs may be oriented and stacked as shown in FIG. 3B, leaving an air gap between adjacent PCBs according to embodiments of the invention, to provide an embodiment of dual-polarized wideband patch antenna element 300. Such an embodiment provides for a relatively easy to manufacture and inexpensive antenna element configuration. In particular, the use of a plurality of two sided PCBs provides a relatively inexpensive and simple to manufacture solution, particularly as compared to a multi-layer PCB configuration. The use of partial coupling, as will be discussed in further detail below, according to embodiments of the invention addresses impedance matching issues facilitating the use of a plurality of two sided PCBs without requiring a more controlled, and more costly, multi-layer PCB configuration.

It should be appreciated that the embodiment of dual-polarized wideband patch antenna element 300 illustrated in FIG. 3A provides a microstrip slot feed configuration in which slot 321 of the signal feed associated with port 1 is centered with respect to patch 310. Likewise, the microstrip feed portion of microstrip line 311 is centered with respect to slot 321. Such a feed slot and microstrip feed configuration provides an embodiment in which the associated radiation pattern is symmetrical as the phase center is the same for the microstrip slot feed and the patch.

Additionally, the embodiment of dual-polarized wideband patch antenna element 300 illustrated in FIG. 3A provides a microstrip slot feed configuration in which slots 322 of the signal feed associated with port 2 are symmetrically disposed with respect to the center of patch 301. The microstrip feed portions of microstrip line 312 are centered with respect to their respective ones of slots 322*a* and 322*b*. Such a feed slot and microstrip feed configuration provides an embodiment in which the associated radiation pattern is symmetrical as the phase center is the same for the slots and the patch.

The orientations of slot 321 associated with port 1 and slots 322 associated with port 2 are orthogonal. That is the orientation of slot 321 provides a first signal polarization (e.g., circular slant left 45 degree) while the orientation of slots 322 provide a second signal polarization (e.g., circular slant right 45 degree). Such an orthogonal slot configuration not only provides dual polarization, but also provides some level of signal isolation between the signals of ports 1 and 2. That is, the orthogonal polarization of the signals provides signal isolation. Such signal isolation, however, is enhanced by the microstrip slot feed configuration of embodiments of the invention.

As can be seen in FIGS. 3A and 3E, microstrip line 312 is divided into two portions. Microstrip line portion 312*a* couples a signal between slot 322*a* and port 2 while microstrip line portion 312*b* couples a signal between slot 322*b* and port 2. The bifurcation of microstrip line 312 into microstrip line portions 312*a* and 312*b* with a selected line width is preferably adapted to provide signals of substantially equal amplitude at the respective slots. For example, microstrip line 312 of embodiments provides a 3 dB signal splitter/combiner configuration. Moreover, microstrip line portions 312*a* and 312*b* of preferred embodiments are adapted to provide the signals at the respective slots 180° out of phase with respect to each other. For example, microstrip line portion 312*a* provides a longer signal feed path than 312*b* by an amount determined to provide the aforementioned 180° phase relationship. Using this feed slot orientation and signal feed attributes according to embodiments enables elimination of coupling of field from the slots of the first and second signal feeds (e.g., providing isolation on the order of 30 dB). For example, due to the signals provided at slots 322*a* and 322*b* being 180° out of phase, the microstrip feeds of microstrip line 312 are essentially balanced +/− signal feeds disposed symmetrically with respect to the micro strip feed of microstrip line 311. This balanced, symmetrical +/− relationship provides excellent cancellation of signals which might otherwise leak between the microstrip feeds associated with port 1 and 2. Accordingly, the illustrated embodiment of dual-polarized wideband patch antenna element 300 provides a dual-polarized, highly decoupled configuration which is relatively easy to manufacture.

Embodiments of a dual-polarized wideband patch antenna utilizes partial coupling with respect to one or more microstrip slot feed thereof in order to provide improved impedance matching without the need for a second patch. Referring again to FIG. 3A, it can be seen that the signal feed configuration utilized with respect to port 2 provides partial coupling between patch 301 and the signal feeds of microstrip line 312. The aforementioned partial coupling is provided according to the illustrated embodiment by disposing slots 322*a* and 322*b* of the signal feed for port 2 such that they are only partially overlaid by patch 301. Such partial coupling facilitates the use of slots having an effective size for operation in a desired RF band while controlling the level of coupling of signal energy between the microstrip feed and patch 301 to thereby facilitate impedance matching.

Figure 4A:
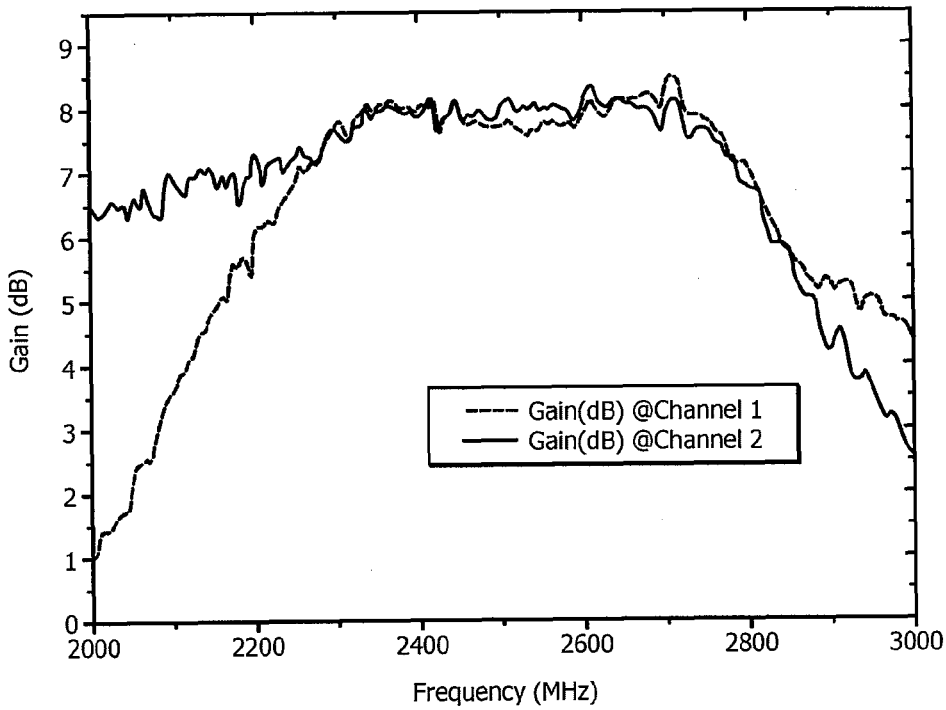
FIGS. 4A-4C show simulated performance characteristics of a dual-polarized wideband patch antenna element of an embodiment of the present invention.
Figure 4B:
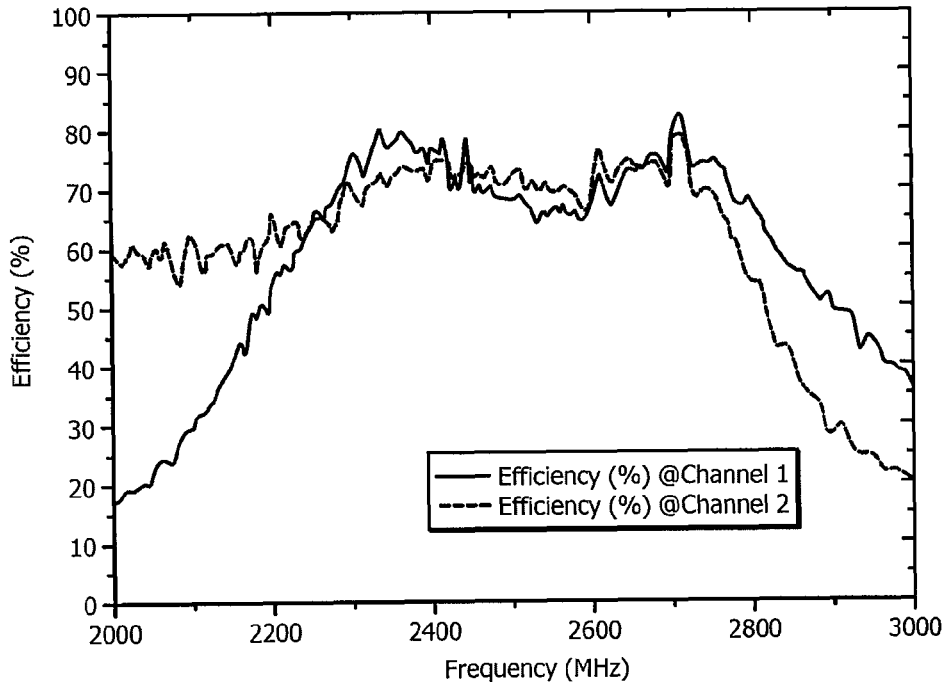
Figure 4C:
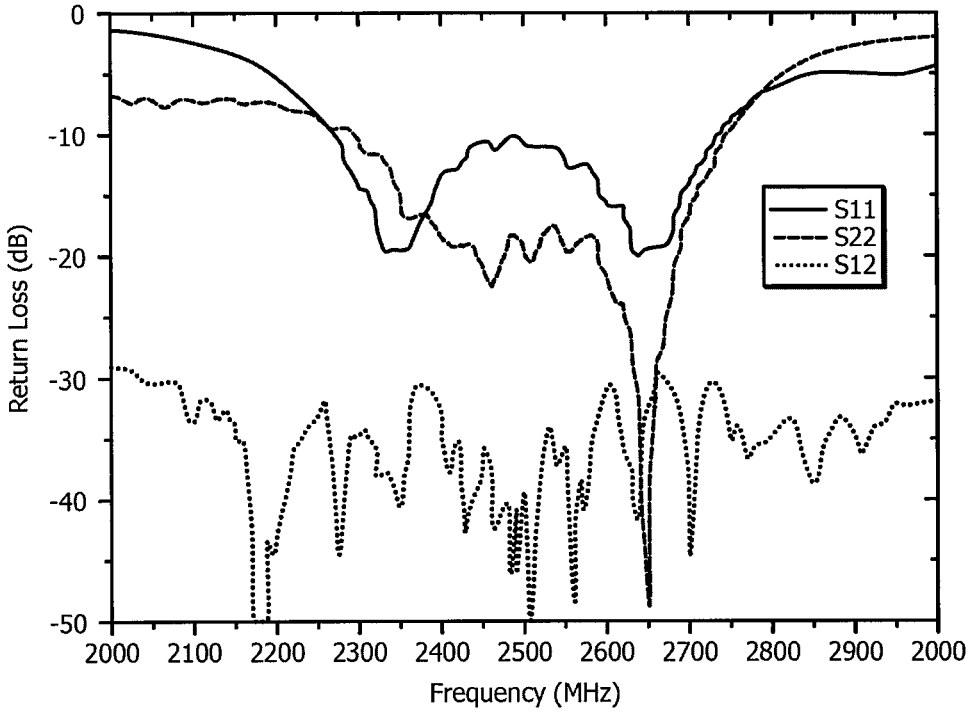
Figure 5A:
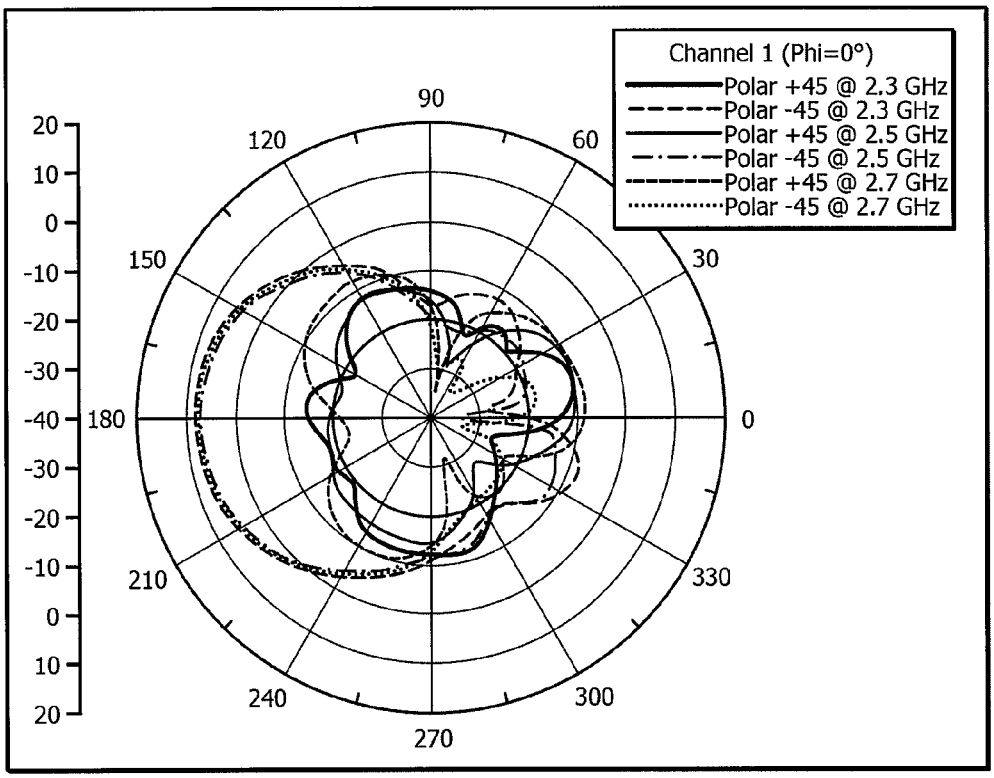
FIGS. 5A-5D show simulated radiation patterns of a dual-polarized wideband patch antenna element of an embodiment of the present invention.
Figure 5B:
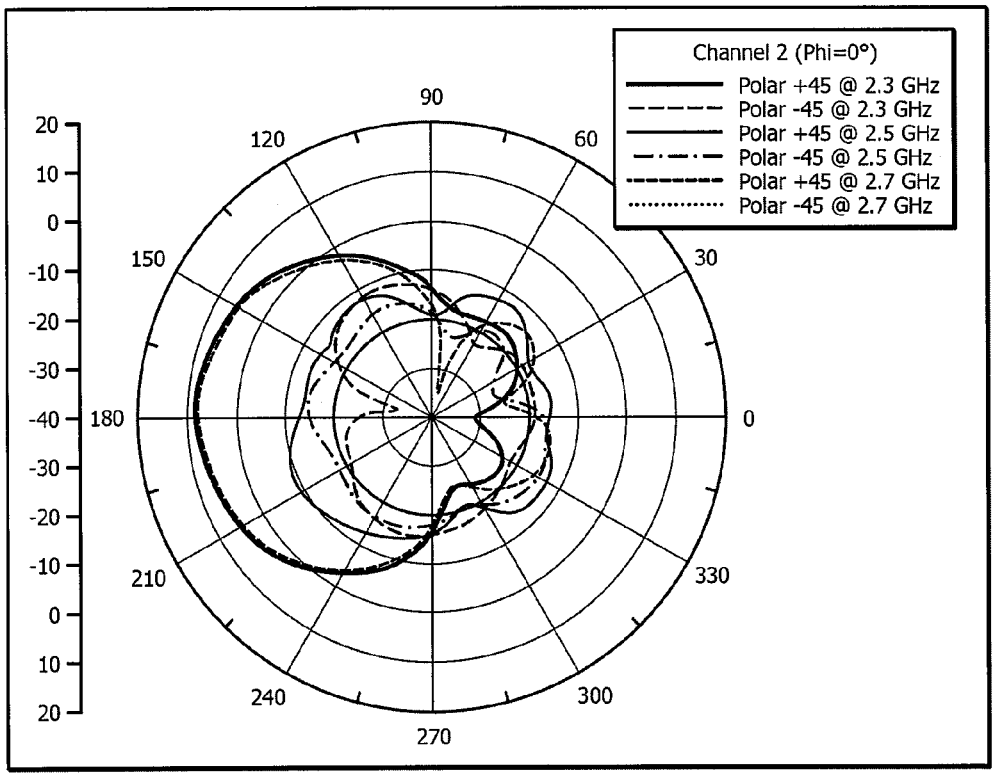
Figure 5C:
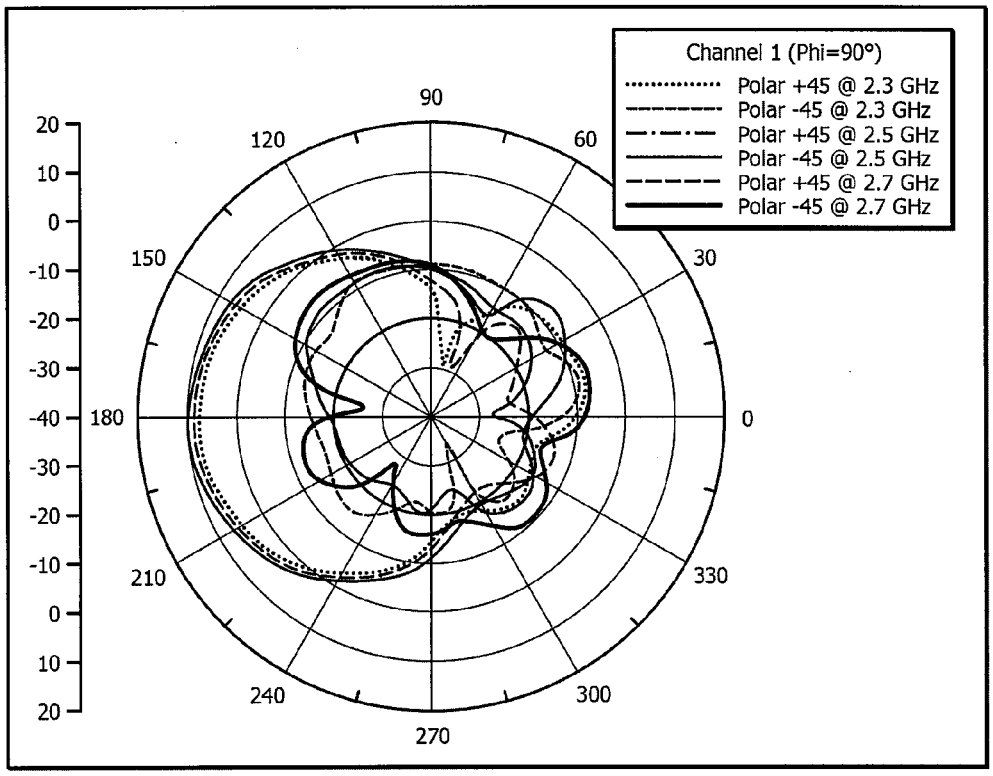
Figure 5D:
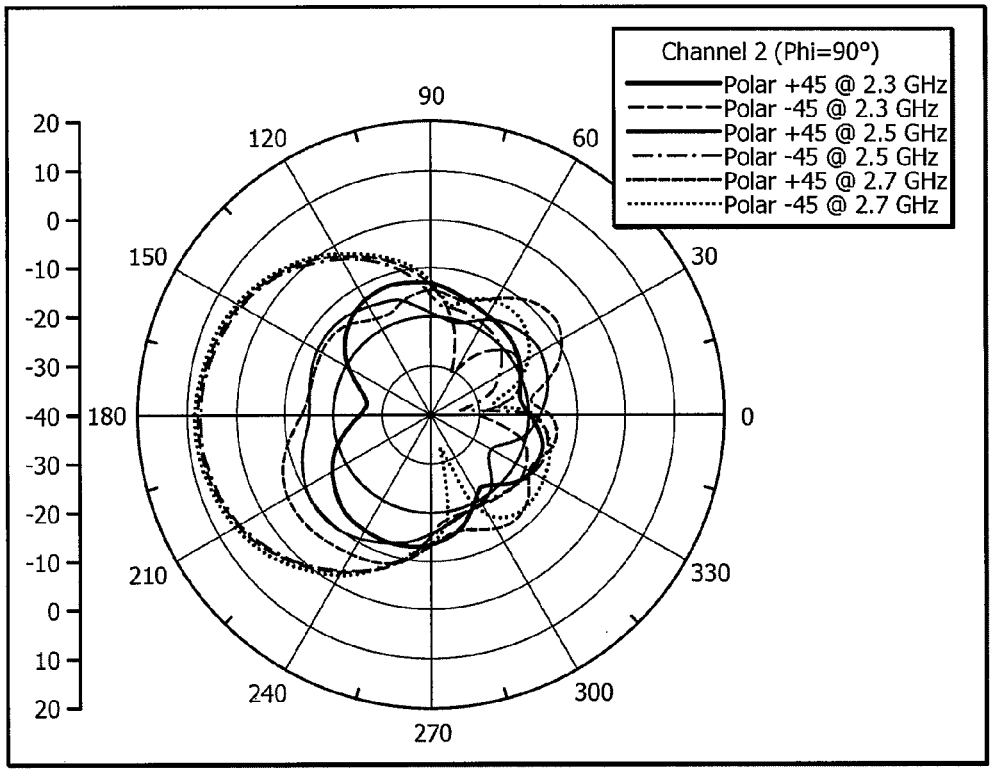

The performance of dual-polarized wideband patch antenna element 300 of the illustrated embodiment was simulated and the resulting performance graphs for signals at port 1 and port 2 throughout a frequency band encompassing 2.3 GHz-2.7 GHz are shown in FIGS. 4A-4C. Specifically, the peak gain graph of FIG. 4A shows that approximately 8 dBi of antenna gain is provided with respect to the signal of both port 1 and port 2 throughout the 2.3 GHz-2.7 GHz frequency band. The antenna efficiency graph of FIG. 4B shows that approximately 70% or more antenna efficiency is achieved with respect to the signal of both port 1 and port 2 throughout the 2.3 GHz-2.7 GHz frequency band. The measurement result graph of FIG. 4C shows that approximately 30 dB (S12) or more of isolation and greater than −10 dB return loss (S11, S22) are achieved as between the signals of port 1 and port 2 throughout the 2.3 GHz-2.7 GHz frequency band. The radiation pattern graphs of FIGS. 5A-5D show that very similar antenna patterns are provided at various frequencies for the signals of both port 1 and port 2.

As previously mentioned, the effective size of the slots affects the operating band of dual-polarized wideband patch antenna element 300. In order to provide operation within a desired RF band (e.g., 2.3 GHz-2.7 GHz) while providing a patch antenna element of relatively small size and yet accommodating a symmetrical disposition of the slots and microstrip feeds, the illustrated embodiment utilizes a "H-slot" configuration. Such a H-slot configuration provides an effective slot size which is larger than the physical slot size, thereby accommodating the central placement of slot 321 while still accommodating the symmetrical placement of slots 322*a* and 322*b* and providing wideband operation in a RF band such as the aforementioned 2.3 GHz-2.7 GHz.

Figure 6A:
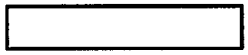
FIGS. 6A-6E show slot configurations as may be utilized in dual-polarized wideband patch antenna elements of embodiments of the present invention.
Figure 6B:
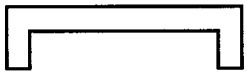
Figure 6C:
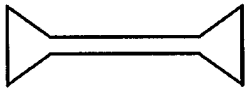
Figure 6D:
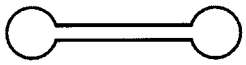
Figure 6E:
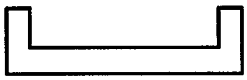

It should be appreciated, however, that embodiments of the invention may utilize slot configurations in addition to or in the alternative to the H-slot configuration of the illustrated embodiments. Moreover, a combination of different slot configurations (e.g., a first slot configuration used in association with port 1 and a second slot configuration used in association with port 2) may be utilized according to embodiments of the invention. For example, in addition to or in the alternative to the aforementioned H-slot configuration, embodiments of the invention may utilize one or more of a rectangular slot configuration (FIG. 6A), a π-slot configuration (FIG. 6B), a slot with triangles configuration (FIG. 6C), a slot with circles configuration (FIG. 6D), a U-slot configuration (FIG. 6E), and/or the like. The particular slot configuration or configurations used may be selected based upon the desired frequency band of operation, the physical size of the patch antenna element, the type of PCB material, the stacking distance between various PCBs, the frequency cutoff characteristics desired, etc.

Figure 7A:
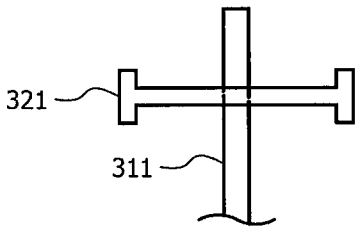
FIGS. 7A and 7B show microstrip feed configurations as may be utilized in dual-polarized wideband patch antenna elements of embodiments of the present invention.
Figure 7B:
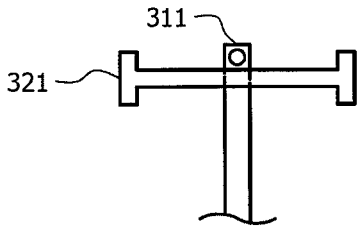

Various signal feed configurations may be utilized according to embodiments of the invention. For example, a microstrip slot feed implemented with respect to an embodiment of the invention may comprise an open stub strip line as illustrated in FIG. 7A. In an open stub strip line, the microstrip line terminates as an open circuit. For example, the microstrip line may extend past the associated slot by a particular amount (e.g., ¼ wavelength) and terminate. Such a microstrip slot feed configuration provides relatively good signal coupling, although occupying space associated with the microstrip extending past the slot. A microstrip slot feed implemented with respect to an alternative embodiment of the invention may comprise a shorted stub strip line as illustrated in FIG. 7B. In a shorted stub strip line, the microstrip line terminates in a short to ground. For example, the microstrip line may terminate with a via to one or more ground plane at a point just past the center of the slot. Such a microstrip slot feed configuration provides acceptable signal coupling while occupying less space than the aforementioned open stub strip line.

Figure 8:
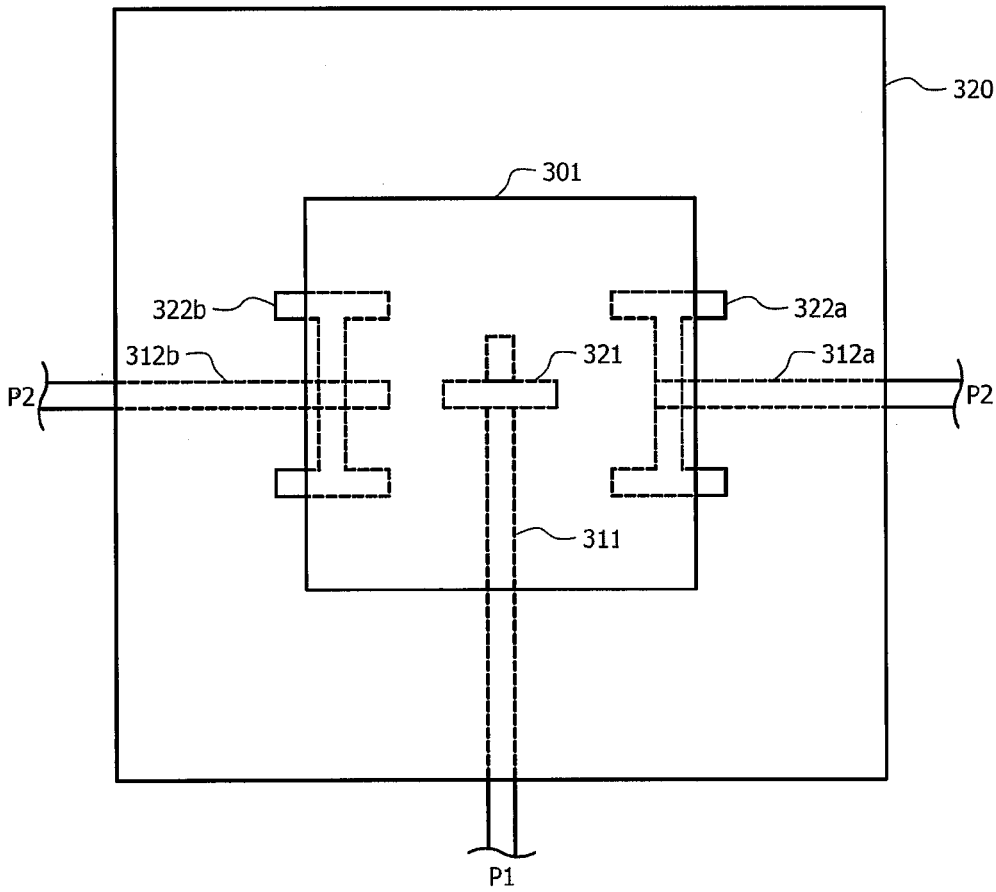
FIG. 8 shows a dual-polarized wideband patch antenna element configuration according to an alternative embodiment of the present invention.

It should be appreciated that the concepts of the present invention are not limited to the microstrip feed, slot, and patch orientations of the embodiments discussed above with respect to FIGS. 3A-3E. For example, rather than the 45° slot offset with the patch shown in FIG. 3A, embodiments of the invention may implement a configuration in which slots are aligned with the patch as shown in FIG. 8. Although such an embodiment provides a larger patch area for a given slot size, as compared to the embodiment of FIG. 3A, different polarizations are provided (e.g., horizontal and vertical).

Having described dual-polarized wideband patch antenna element configurations according to embodiments of the invention, it should be appreciated that a plurality of such antenna elements may be readily incorporated into an antenna element array, such as to provide a base station antenna array.

The components of multiple dual-polarized wideband patch antenna elements may be provided on PCBs or other appropriate support structure used to manufacture antenna arrays. The microstrip feed network utilized according to embodiments of the invention is simplified and does not require the use of jumpers, vias, or crossovers, thereby facilitating relatively simple manufacturing of such antenna arrays.

Figure 9:
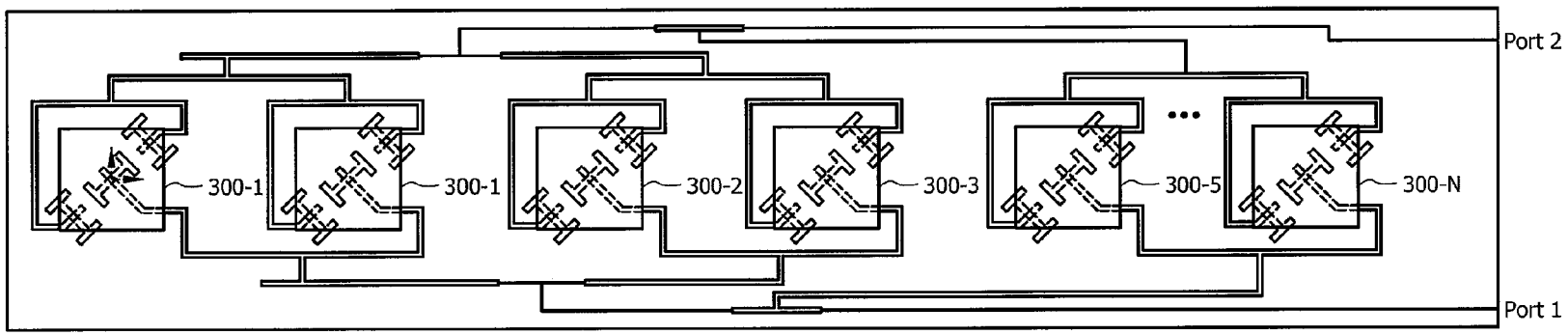
FIG. 9 shows an antenna array formed using a plurality of dual-polarized wideband patch antenna elements according to an embodiment of the present invention.

FIG. 9 shows an antenna element column comprised of a plurality of dual-polarized wideband patch antenna elements according to an embodiment of the present invention. Specifically, dual-polarized wideband patch antenna elements 300-1 through 300-N are shown. A feed network of microstrip lines is provided to provide signal communication with respect to dual-polarized wideband patch antenna elements 300-1 through 300-N avoids the use of jumpers, vias, and crossovers thereby providing a configuration which is relatively simple to manufacture. A plurality of such antenna arrays may be utilized at a base station, such as to provide signal diversity, MIMO communications, selectable/controllable directional communications, smart antenna configurations, adaptive array configurations, etc. Such antenna elements, antenna element arrays, and/or antenna systems may be utilized in provided wireless communications in accordance with WiFi, WiMAX, WiBro, 3G, 4G, LTE, and other popular communication standards.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A patch antenna element comprising:

a conductive patch; and a first microstrip slot feed, wherein the first microstrip slot feed comprises at least one slot disposed in a ground plane and a corresponding strip line feed, and wherein the first microstrip slot feed is symmetrical with respect to a center of the conductive patch; and a second microstrip slot feed, wherein the second microstrip slot feed comprises a plurality of slots disposed in the ground plane and corresponding strip line feeds, wherein the second microstrip slot feed is symmetrical with respect to a center of the conductive patch and is symmetrical with respect to the first microstrip slot feed, wherein the second microstrip slot feed is partially coupled with respect to the conductive patch, wherein the plurality of slots of the second microstrip slot feed are disposed near edges of the conductive patch, and wherein the partial coupling of the second microstrip slot feed is provided by each of the plurality of slots of the second microstrip slot feed extending past one or more respective edge of the edges of the conductive patch and is 45' offset with respect to an orientation of the conductive patch.

2. The patch antenna element of claim 1, wherein a signal at a first strip line feed of the strip line feeds of the second microstrip slot feed is 180° out of phase with a signal at a second strip line feed of the strip line feeds of the second microstrip slot feed.

3. The patch antenna element of claim 2, wherein the 180° out of phase relationship of the first and second strip line feeds of the second microstrip slot feed is adapted to provide isolation with respect to a signal at the strip line feed of the first microstrip slot feed.

4. The patch antenna element of claim 1, wherein the at least one slot of the first microstrip slot feed and the plurality of slots of the second microstrip slot feed are sized and shaped to facilitate resonance of the patch antenna element in a broadband operating frequency band.

5. The patch antenna element of claim 4, wherein the broadband operating frequency band is a band of approximately 2.3 GHz-2.7 GHz.

6. The patch antenna element of claim 4, wherein an orientation of the at least one slot of the first micro strip slot feed is 45° offset with respect to an orientation of the conductive patch.

7. The patch antenna element of claim 4, wherein an orientation of the at least one slot of the first microstrip slot feed and the second microstrip slot feed is aligned with respect to an orientation of the conductive patch.

8. The patch antenna element of claim 4, further comprising:

a first printed circuit board, wherein the conductive patch is disposed upon the first printed circuit board; and a second printed circuit board, wherein the ground plane into which the at least one slot of the first microstrip slot feed and the plurality of slots of the second microstrip slot feed are disposed upon a first side of the second printed circuit board, and wherein strip line feed of the first microstrip slot feed and the strip line feeds of the second microstrip slot feed are disposed upon a second side of the second printed circuit board.

9. The patch antenna element of claim 8, further comprising:

a third printed circuit board, wherein a ground plane is disposed upon the third printed circuit board.

10. The patch antenna element of claim 9, wherein the first, second, and third printed circuit boards comprise single layer circuit boards provided in a stacked configuration to form the patch antenna element.

11. The patch antenna element of claim 1, wherein the first microstrip slot feed is associated with a first port of the patch antenna element and the second microstrip slot feed is associated with a second port of the patch antenna element.

12. A patch antenna element comprising:

a conductive patch; and a first microstrip slot feed associated with a first port of the patch antenna element and adapted for communication of radio frequency signals between a signal conductor associated with the first port and the conductive patch, wherein the first microstrip slot feed is symmetrical with respect to a center of the conductive patch; and a second microstrip slot feed associated with a second port of the patch antenna element and adapted for communication of radio frequency signals between a signal conductor associated with the second port and the conductive patch, wherein the second microstrip slot feed is symmetrical with respect to a center of the conductive patch, wherein the second microstrip slot feed is partially coupled with respect to the conductive patch, wherein the partial coupling of the second microstrip slot feed is provided by each of a plurality of slots of the second microstrip slot feed extending past one or more respective edge of the edges of the conductive patch and is 45' offset with respect to an orientation of the conductive patch.

13. The patch antenna element of claim 12, wherein the second microstrip slot feed comprises a plurality of slots disposed near edges of the conductive patch.

14. The patch antenna element of claim 12, wherein the second microstrip slot feed is symmetrical with respect to the first microstrip slot feed.

15. The patch antenna element of claim 14, wherein the first microstrip slot feed is centered with respect to the conductive patch, and wherein the second microstrip slot feed is symmetrically disposed with respect to the center of the conductive patch.

16. The patch antenna element of claim 12, wherein a signal as coupled between a first portion of the second microstrip slot feed and the conductive patch is 180° out of phase with a signal as coupled between a second portion of the second microstrip slot feed.

17. The patch antenna element of claim 16, wherein a first slot of the second microstrip slot feed is associated with the first portion of the second microstrip slot feed and a second slot of the second microstrip slot feed is associated with the second portion of the second microstrip slot feed.

18. The patch antenna element of claim 16, wherein the signal conductor associated with the second port is adapted to provide the 180° phase relationship between the first and second portions of the second microstrip slot feed.

19. The patch antenna element of claim 12, wherein the first microstrip slot feed and the second microstrip slot feed each comprise at least one slot disposed in a ground plane, wherein the at least one slot of the first microstrip slot feed and the at least one slot of the second microstrip slot feed are sized and shaped to facilitate resonance of the patch antenna element in a broadband operating frequency band.

20. The patch antenna element of claim 19, wherein the broadband operating frequency band is a band of approximately 2.3 GHz-2.7 GHz.

21. The patch antenna element of claim 19, wherein the size and shape of the at least one slot of at least one of the first micro strip slot feed and the second microstrip slot feed provides an effective slot size which is larger than a physical slot size.

22. The patch antenna element of claim 19, wherein an orientation of the at least one slot of the first microstrip slot feed and the second microstrip slot feed is 45° offset with respect to an orientation of the conductive patch.

23. The patch antenna element of claim 19, wherein an orientation of the at least one slot of the first microstrip slot feed and the second microstrip slot feed is aligned with respect to an orientation of the conductive patch.

24. The patch antenna element of claim 19, wherein an open stub strip line feed is provided for a microstrip slot feed implemented with respect to the at least one slot of at least one of the first microstrip slot feed and the second microstrip slot feed.

25. The patch antenna element of claim 19, wherein a shorted stub strip line feed is provided for a microstrip slot feed implemented with respect to the at least one slot of at least one of the first microstrip slot feed and the second microstrip slot feed.

26. The patch antenna element of claim 19, further comprising:

a first printed circuit board, wherein the conductive patch is disposed upon the first printed circuit board; and a second printed circuit board, wherein a ground plane into which the at least one slot of the first microstrip slot feed and the at least one slot of the second microstrip slot feed are disposed upon a first side of the second printed circuit board, and wherein the signal conductor associated with the first port and the signal conductor associated with the second port are disposed upon a second side of the second printed circuit board.

27. The patch antenna element of claim 26, further comprising:

a third printed circuit board, wherein a ground plane is disposed upon the third printed circuit board.

28. The patch antenna element of claim 27, wherein the first, second, and third printed circuit boards comprise single layer circuit boards provided in a stacked configuration to form the patch antenna element.

* * * * *

UNITED STATES PATENT AND TRADEMARK OFFICE

CERTIFICATE OF CORRECTION

PATENT NO. : 8,890,750 B2
APPLICATION NO. : 13/229274
DATED : November 18, 2014
INVENTOR(S) : Angus Chi Keung Mak et al.

It is certified that error appears in the above-identified patent and that said Letters Patent is hereby corrected as shown below:

In the Specification:

At column 7, line number 28, delete “micro strip” and replace with --microstrip--.

In the Claims:

At column 10, claim number 1, line number 2, delete “45'” and replace with --45°--.

At column 10, claim number 6, line number 23, delete “micro strip” and replace with --microstrip--.

At column 11, claim number 12, line number 7, delete “45'” and replace with --45°--.

At column 12, claim number 21, line number 3, delete “micro strip” and replace with --microstrip--.

Signed and Sealed this
Third Day of March, 2015

Michelle K. Lee

Michelle K. Lee
*Deputy Director of the United States Patent and Trademark Office*